US011021929B2

(12) United States Patent
Gosselin et al.

(10) Patent No.: US 11,021,929 B2
(45) Date of Patent: Jun. 1, 2021

(54) POSITIVE CEMENT PLACEMENT TOOL

(71) Applicant: SLURRY SOLUTIONS INC., High River (CA)

(72) Inventors: Randy Gosselin, Calgary (CA); Trevor James Montgomery, Calgary (CA)

(73) Assignee: SLURRY SOLUTIONS, INC., High River (CA)

( * ) Notice: Subject to any disclaimer, the term of this patent is extended or adjusted under 35 U.S.C. 154(b) by 243 days.

(21) Appl. No.: 16/192,452

(22) Filed: Nov. 15, 2018

(65) Prior Publication Data

US 2019/0085655 A1 Mar. 21, 2019

Related U.S. Application Data

(62) Division of application No. 15/129,774, filed as application No. PCT/CA2015/050236 on Mar. 26, 2015, now abandoned.

(60) Provisional application No. 61/971,345, filed on Mar. 27, 2014.

(51) Int. Cl.
*E21B 17/10* (2006.01)
*E21B 33/14* (2006.01)

(52) U.S. Cl.
CPC ..... *E21B 33/14* (2013.01); *E21B 17/10* (2013.01); *E21B 17/1078* (2013.01)

(58) Field of Classification Search
CPC .. E21B 17/1057; E21B 17/1064; E21B 33/14; E21B 17/10; E21B 17/1078
See application file for complete search history.

(56) References Cited

U.S. PATENT DOCUMENTS 1,700,305 A * 1/1929 Bell ..... E21B 37/10 92/185
2,150,406 A * 3/1939 Taylor ..... E21B 37/08 166/119
2,272,963 A * 2/1942 Budd ..... 428/675
3,087,550 A * 4/1963 Tyrrell, Jr. ..... E21B 37/02 166/173
3,176,771 A * 4/1965 Claiborne ..... E21B 37/02 166/173
3,205,945 A * 9/1965 Holt, Jr. ..... E21B 33/14 166/286
3,329,212 A * 7/1967 Pourchot ..... E21B 37/02 166/176
3,351,136 A * 11/1967 Nelson ..... E21B 17/1035 166/173
3,814,182 A * 6/1974 Giroux ..... E21B 34/125 166/331

(Continued)

*Primary Examiner* — Steven A MacDonald
(74) *Attorney, Agent, or Firm* — Parlee McLaws LLP

(57) ABSTRACT

Cement slurry injected or delivered into a wellbore during cementing operations can be positively placed with a positive placement tool. The tool can be located along to a casing string and have a mandrel with a tubular centralizer sleeve rotatably fit thereabout, the centralizer sleeve having one or more radial guides extending longitudinally thereon. Reciprocal stroking of the casing string causes a helical drive arrangement, acting between the mandrel and the centralizer sleeve, to drive the centralizer sleeve longitudinally along a length of the mandrel while concurrently rotating the centralizer sleeve thereabout. The rotational movement of the centralizer sleeve provides positive impetus to force the injected cement slurry fully about the casing string.

9 Claims, 7 Drawing Sheets

(56) References Cited

U.S. PATENT DOCUMENTS

| | | | | | |
|---|---|---|---|---|---|
| 4,080,010 | A * | 3/1978 | Young | E21B 10/30 | 175/325.3 |
| 4,102,552 | A * | 7/1978 | Kellner | E21B 10/24 | 175/325.3 |
| 4,595,058 | A * | 6/1986 | Nations | E21B 17/1078 | 166/242.1 |
| 5,247,990 | A * | 9/1993 | Sudol | E21B 17/1042 | 166/241.3 |
| 5,277,254 | A * | 1/1994 | Rullman | E21B 17/22 | 166/241.4 |
| 6,062,326 | A * | 5/2000 | Strong | E21B 7/20 | 175/402 |
| 6,182,754 | B1 * | 2/2001 | Vermeeren | E21B 17/1071 | 166/176 |
| 7,392,861 | B2 * | 7/2008 | Fouillou | E21B 47/01 | 175/325.1 |
| 2007/0215388 | A1 * | 9/2007 | Kirk | E21B 17/1057 | 175/327 |
| 2009/0056497 | A1 * | 3/2009 | Swinford | E21B 17/073 | 74/640 |
| 2010/0258318 | A1 * | 10/2010 | Wolf | E21B 37/02 | 166/311 |
| 2012/0285743 | A1 * | 11/2012 | Gosselin | E21B 37/00 | 175/53 |

* cited by examiner

POSITIVE CEMENT PLACEMENT TOOL

FIELD

Embodiments disclosed herein relate to centralizers and more particularly to centralizers that are controllably rotatable for positively displacing annular cement injected downhole during cementing operations.

BACKGROUND

It is common practice in the oil and gas industry to cement casing within a wellbore, after drilling the wellbore to depth, by introducing cement into an annular space between the wellbore and the casing. This process of cementing is often completed for various reasons, including restricting fluid movement between zones in a formation and to bond and support the casing within the wellbore.

Cementing is typically performed by injecting and circulating cement slurry through an internal bore of the casing string from the surface, and into the annulus through a valve or casing shoe located at the bottom of the casing string. Often, casing strings can also incorporate float shoes or float collars to prevent backflow of the cement slurry during cementing.

To ensure proper bonding between the casing and the wellbore, the casing string can be centralized within the wellbore, providing an annulus having an uniform thickness. In ideal circumstances, the wellbore and the casing string would be substantially concentric.

In vertical wellbores, centralizers can be used to provide sufficient annular space between the casing and the wellbore for the cement slurry during cementing operations.

In horizontal wellbores, or wellbores having a laterally extending section, the force of gravity acting on the casing string causes the casing string to rest or lay on or adjacent a bottom of the wellbore. Further, during drilling, portions of the bottom of the wellbore may be washed away to form small pockets or cavities that can lie underneath the casing string, along the bottom of the wellbore wall. Accordingly, there may be portions along a casing string in a horizontal wellbore that may not have sufficient annular space between the casing string and the bottom surface of the wellbore to permit a satisfactory cement placement and bonding.

As with vertical wellbores, centralizers can be deployed along the casing string for use in the laterally extending sections or along horizontal wellbores to space the casing from the bottom of the wellbore. However, the injection of the cement slurry into the annular space solely relies on fluid dynamics, the cement taking the path of least resistance, tending to travel along the open top and sides of the casing string. As a result there can be multiple locations along the bottom of a horizontal or lateral section of the wellbore where the extent of bonding is less than optimal.

Further, and due to recent regulations for increasing environmental safety, many regulatory bodies now require bond logs to evidence sufficient bonding between the casing and the wellbore.

Accordingly, there is a need to ensure that a sufficient amount of cement is placed between the casing and the walls of a wellbore, particularly between the casing and the bottom surface of a horizontal wellbore, to achieve sufficient bonding therebetween for satisfying the completion objectives, regulatory requirements and permitting further downhole operations.

SUMMARY

Centralizers, being able to either freely rotate about a casing string or not rotate at all, cannot mechanically provide additional or positive impetus to move, positively direct, or otherwise force cement slurry, injected into a laterally extending or horizontal section of a wellbore, about and along the casing string, particularly under the casing string.

A positive cement placement tool, disposed along a casing string in laterally extending or horizontal sections of a wellbore, can mechanically provide a positive impetus for positively directing or forcing the injected cement slurry about and along a casing string. In embodiments, the tool can comprise a centralizer, which can be actuated to rotate about the casing string, for forcing the injected cement slurry around and along the casing string. In embodiments, the tool can be actuated to rotate in a first direction and then in a second opposite direction by the reciprocal uphole and downhole stroking of the casing string, for mechanically providing positive impetus to force the cement slurry around and along the casing string.

In a broad aspect, a positive placement tool can be located along a casing string for placing a cement slurry about the casing string. The cement placement tool can comprise a mandrel adapted for location within the casing string, a centralizer sleeve fit concentrically and movable on the mandrel, and a helical drive arrangement acting between the mandrel and the centralizer sleeve for actuating the centralizer sleeve along a length of the mandrel while rotating the centralizer sleeve thereabout. The centralizer sleeve further comprises one or more radial guides extending generally longitudinally along the sleeve for engaging the cement slurry.

BRIEF DESCRIPTION OF THE DRAWINGS

FIG. 7A illustrates an initial injection of the cement slurry, the cement slurry filling an upper portion of the wellbore;

FIG. 7B illustrates the beginning of the downhole stroke of the casing string and the cement slurry being forced about the tool and casing string; and FIG. 7C illustrates the cement slurry after the placement tool has forced the cement slurry about the tool and the casing string.

DESCRIPTION

A positive cement placement tool can be incorporated or located within a casing string and run downhole for use during cementing operations. During cementing operations, and as cement slurry is injected or otherwise delivered into the wellbore, the positive cement placement tool can be actuated by reciprocating the casing string. A stroking the casing string, alternating between an uphole and a downhole movement, positively directs or otherwise forces the cement slurry about and along the tool. The cement slurry is also distributed along the casing string. Typically, a plurality of tools are spaced along the casing string.

Embodiments of a positive cement placement tool described herein generally comprise a tubular mandrel having a controllably rotatable centralizer positioned thereabout. The casing string is reciprocated, also reciprocating the mandrel. A helical drive mechanism, positioned between the mandrel and the centralizer, actuates or drives the centralizer to move relatively along a length of the mandrel and to concurrently rotate thereabout. The centralizer rotates in a first direction when the casing string is stroked uphole, and rotates in an opposite second direction when the casing string is stroked downhole. The rotation of the centralizer imparts a positive and mechanical impetus to force the cement slurry about the tool.

Figure 1A:
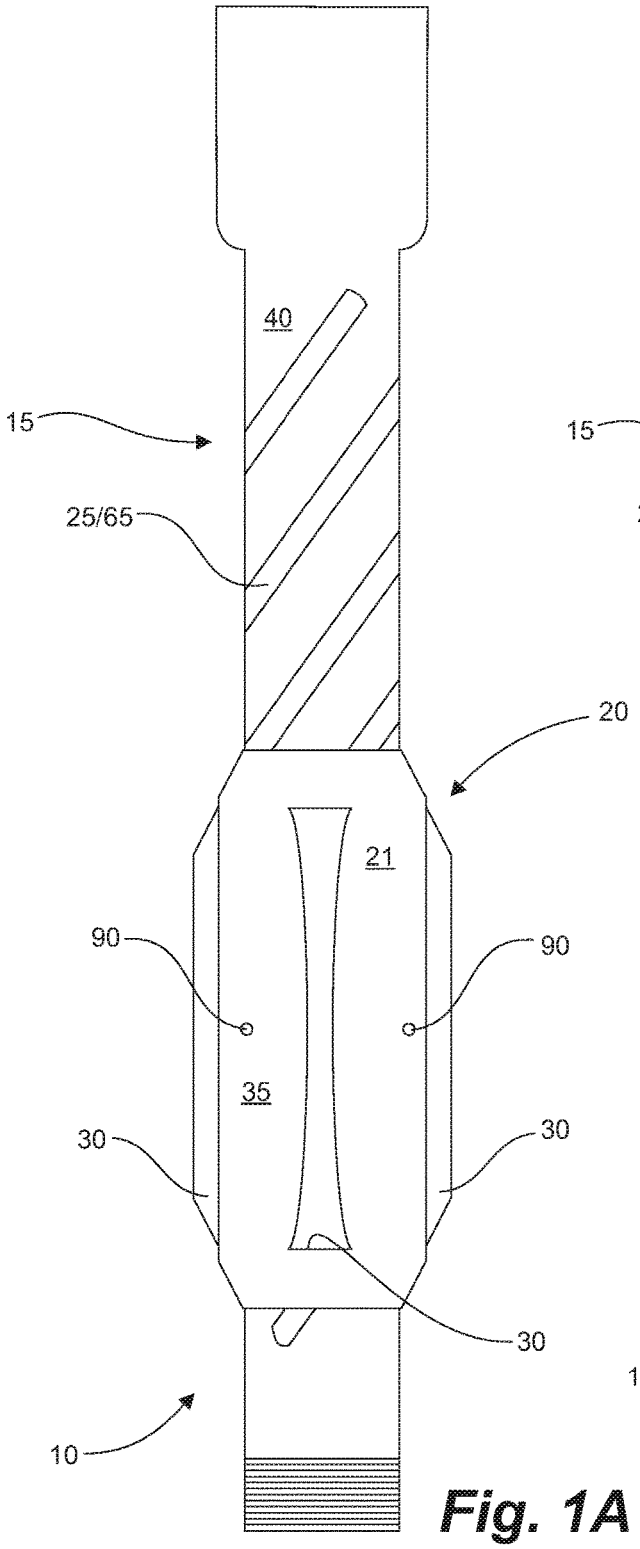
FIG. 1A is a side view of an embodiment of the positive placement tool illustrating a mandrel adapted to be located along to a casing string, a rotatable centralizer, and helical grooves on the mandrel forming a portion of a helical drive arrangement.
Figure 1B:
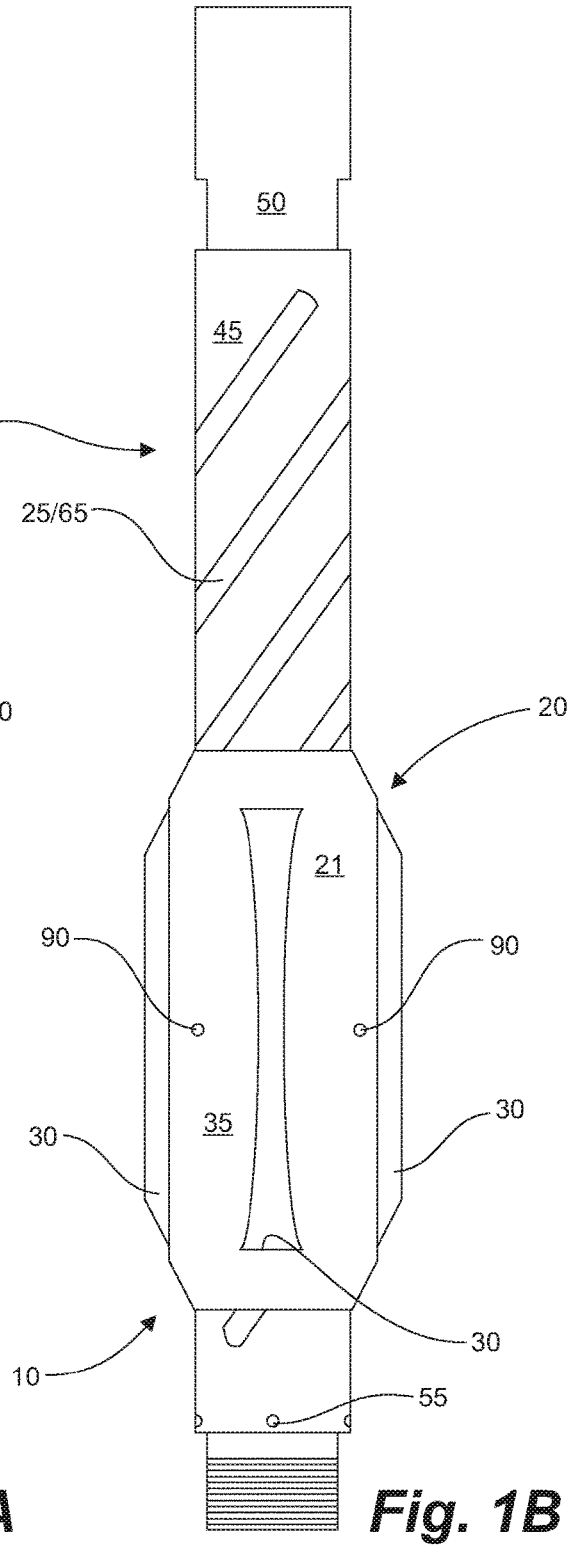
FIG. 1B is a side view of another embodiment of the positive placement tool, illustrating a mandrel sleeve secured to a section of a casing string, a rotatable centralizer, and helical grooves on the mandrel sleeve forming a portion of a helical drive arrangement.

In more detail, and with reference to FIGS. 1A and 1B, a positive cement placement tool 10 comprises a tubular mandrel 15. One or more mandrels 15 are formed integral with or are secured within, and spaced along, a casing string (see FIG. 6A) for providing one or more centralizer locations therealong. A tubular centralizer 20 is concentrically fit about to each tubular mandrel 15 and operationally actuable by a helical drive arrangement 25, for reciprocal movement therealong and concurrent rotational movement thereabout.

The tubular centralizer 20 comprises a tubular centralizer sleeve 21 and one or more fins or radial guides 30 extending generally axially along a length of the sleeve 21, and extending radially from an outer surface 35 thereof. Each radial guide 30 spaces the centralizer sleeve 21 from the wellbore, forming a space for receipt of cement slurry therein. When rotated, the guides engage the cement slurry for movement from one radial location and forcing the cement slurry further and circumferentially about tool 10. The form of the radial guides 30 can include axially-extending through helical-extending. Typically a centralizer has three or more radial guides, spaced circumferentially thereabout.

In an embodiment, the one or more radial guides 30 can be two or more radial guides spaced apart circumferentially along the outer surface 35 of the centralizer sleeve 21.

As shown in FIG. 1A, and in an embodiment, the tubular mandrel 15 can be a section of casing 40 adapted to be incorporated as part of the casing string. As shown, the section of casing 40 is secured within the casing string such as by threadable attachment uphole and downhole thereof.

In another embodiment, and as shown in FIG. 1B, the mandrel 15 can be a mandrel sleeve 45 having a sleeve bore extending longitudinally therethrough, for concentrically fitting about a tubing section of the casing string.

In the embodiment illustrated in FIG. 1B, the mandrel sleeve 45 is slidably fit concentrically about a section 50 of the casing string. The mandrel sleeve 45 is rotationally secured to the casing string section 50 and fixed longitudinally therealong. Set screws 60 can be inserted through a plurality of holes 55, spaced apart circumferentially about the outer surface of the mandrel sleeve 45 and extend radially therethrough to engage the casing section 50. Although not shown, in other embodiments, the mandrel sleeve 45 can be secured to the casing string by other attachment means, such as one or more locking collars.

Generally, the helical drive arrangement 25 cooperates between the mandrel 15 and the centralizer 20 and controllably actuates the centralizer 20 to rotate about the mandrel 15 as the mandrel 15 moves therethrough, enabling the centralizer 20 to be controllably actuable longitudinally and rotationally relative to the mandrel 15 and the casing string.

Figure 2A:
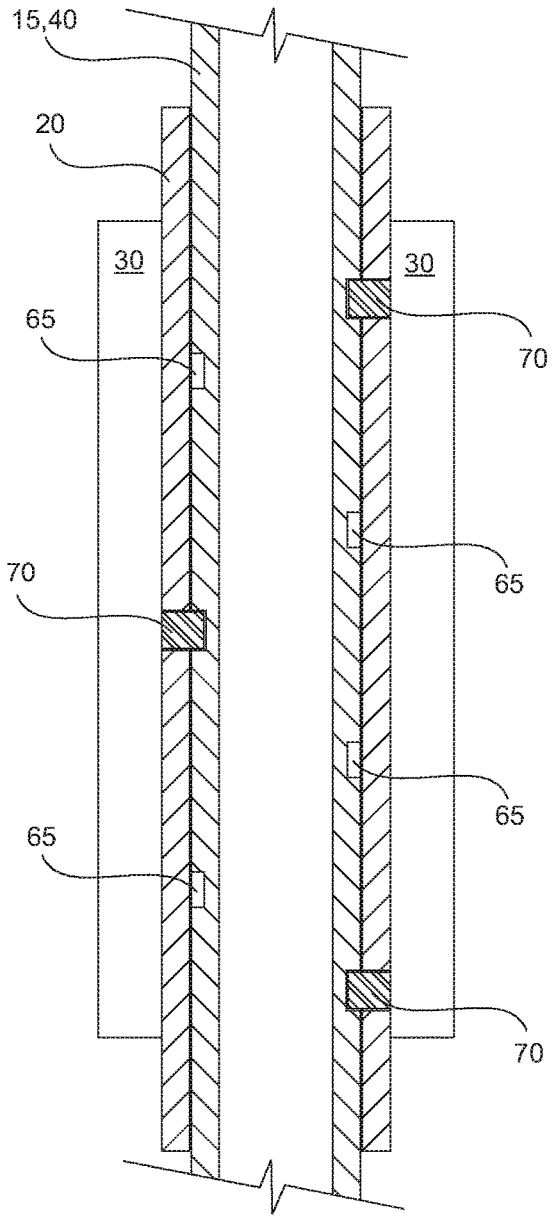
FIG. 2A is a side cross-sectional view of FIG. 1A, illustrating the body, a centralizer sleeve moveably supported about the mandrel, and the helical drive arrangement comprising a guide pin extending through the centralizer sleeve and a helical groove along a surface of the mandrel for accepting the guide pin.
Figure 2B:
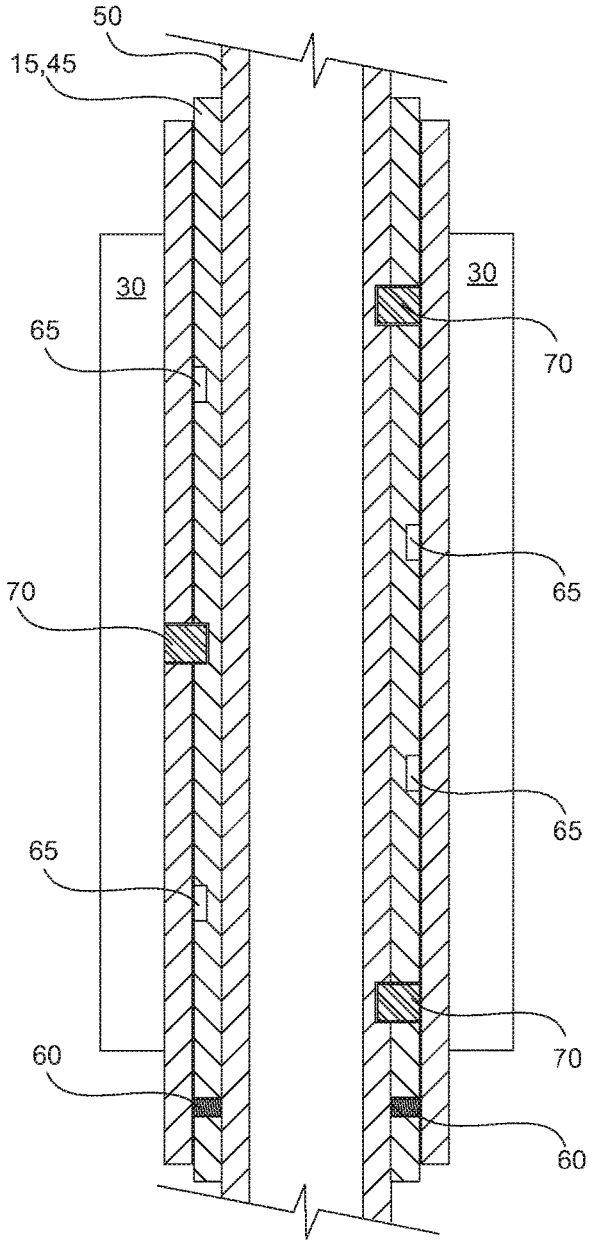
FIG. 2B is a side cross-sectional view of FIG. 1B, illustrating the mandrel sleeve secured to a section of a casing string by set screws, a centralizer sleeve moveably supported about the mandrel sleeve, and the helical drive arrangement comprising a guide pin extending through the centralizer sleeve and helical grooves along a surface of the mandrel for accepting the guide pin.

With reference to FIGS. 2A and 2B, the helical drive arrangement 25 comprises one or more helical slots or grooves 65 cooperating with one or more guide pins 70 for guiding the centralizer 20 rotationally and longitudinally relative to the mandrel 15. In an embodiment, the one or more helical grooves 65 are formed on an outer surface 75 of the mandrel 15. In an alternate embodiment, the one or more helical grooves 65 can be formed on an inner surface of the centralizer (not shown). The pins 70 are formed on the opposing and complementary component, either the centralizer 20 or mandrel 15 respectively. Particularly, the one or more guide pins 70 extend radially from the other of the inner surface of the centralizer to slots in the mandrel 15 or, alternatively, from the outer surface of the mandrel 15 where the one or more helical grooves 65 are formed on the inner surface of the centralizer 20. An embodiment of the helical drive arrangement is disclosed in U.S. Pat. No. 8,973,682.

Figure 3:
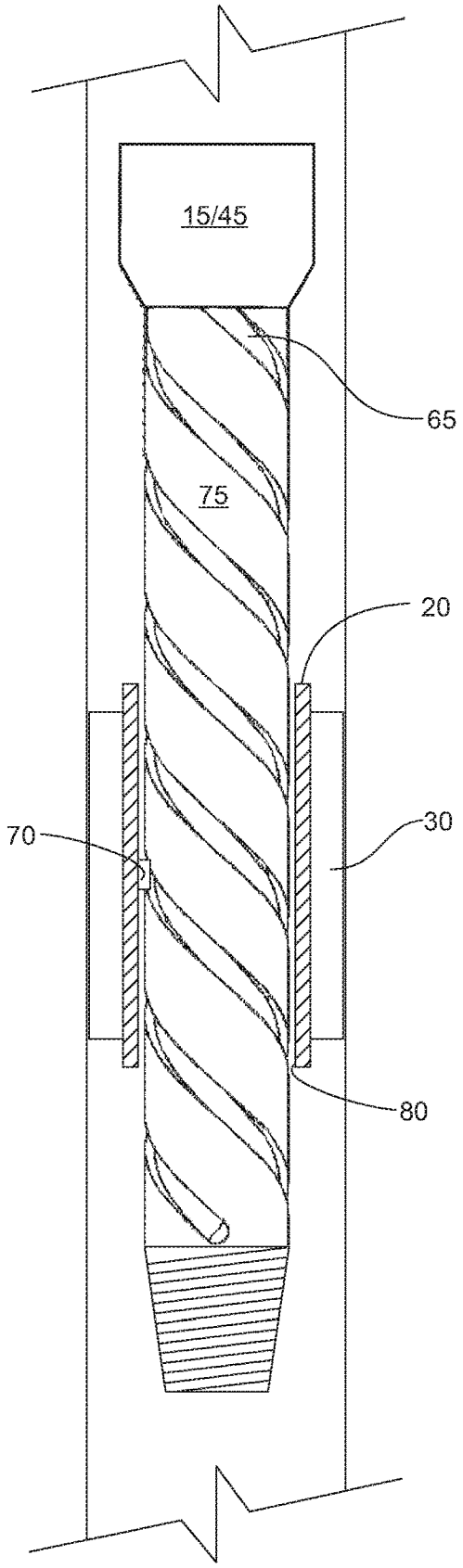
FIG. 3 is a partial cross-sectional view of the embodiment shown in FIG. 1A, illustrating an embodiment of the helical drive arrangement between the mandrel and the rotatable centralizer, the helical drive arrangement.
Figure 4:
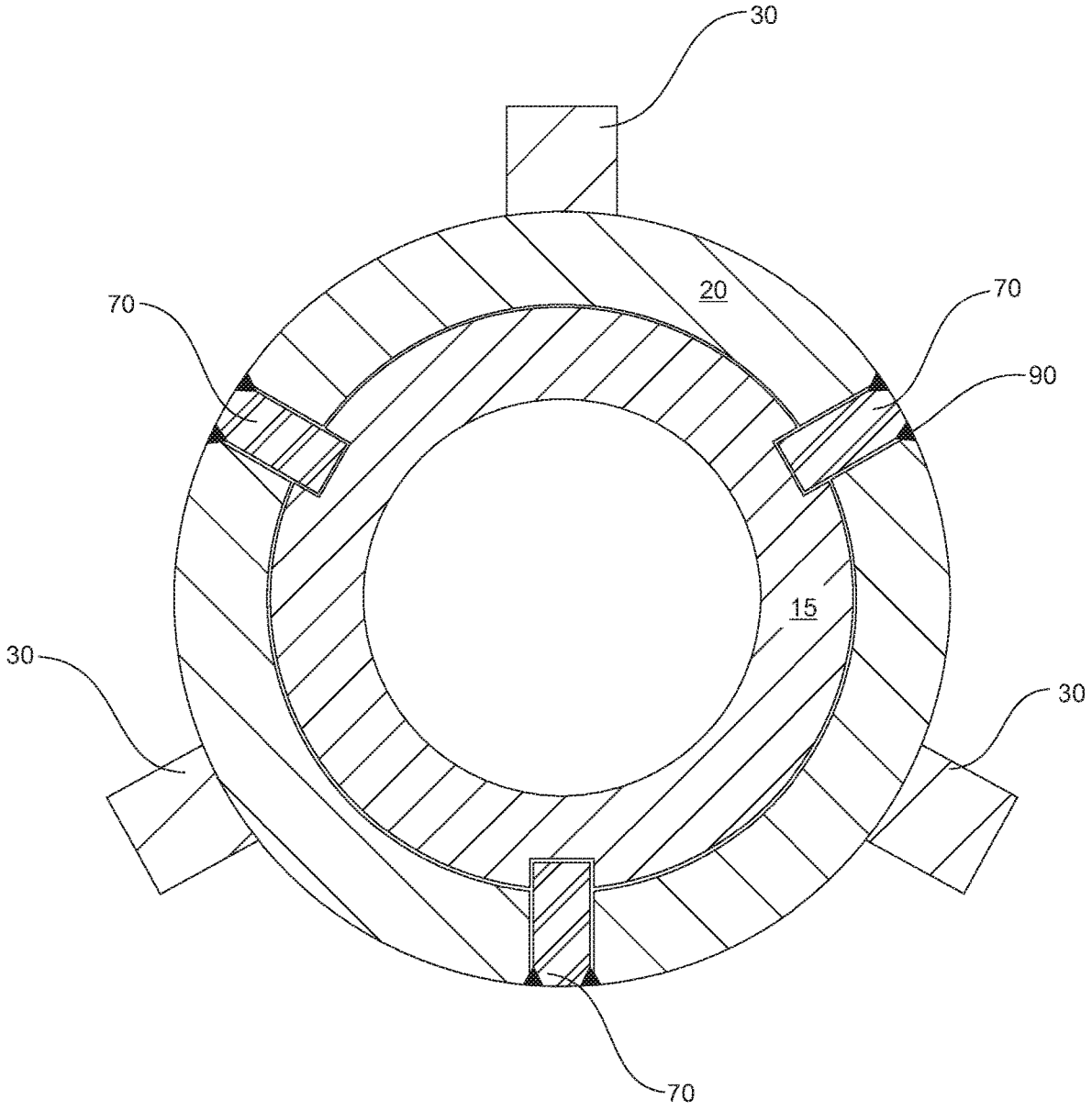
FIG. 4 is plan cross-sectional view of a FIG. 3, illustrating three guide pins engaging the helical groove.

With reference to the embodiment of FIGS. 3 and 4, the helical drive arrangement 25 comprises at least one helical groove 65 along the outer surface 75 of the mandrel 15, and three guide pins 70,70,70, equally spaced apart and extending radially inwardly from an inner surface 80 of the centralizer 20. Each of the three guide pins 70,70,70 extend from the inner surface of the centralizer 20 and is received in the at least one helical groove 65. Accordingly, as the guide pins 70,70,70 are located within the helical groove 65, the guide pins 70,70,70 follow a travel path defined by the at least one helical groove 65, causing the centralizer 20 to travel along the length of the mandrel 15 while concurrently rotating thereabout.

Thus, stroking the casing string in one direction will cause the centralizer 20 to rotate about the mandrel 15 in a first direction, providing positive impetus for forcing the cement slurry ahead of the radial guides 30 from one circumferential location to another circumferential location about the tool 10. The longitudinal travel of the casing string and of the centralizer 20 along the mandrel 15 of tool 10 provides positive impetus for forcing or pushing the cement slurry axially along the tool 10 and along the casing string.

The stroking of the casing string in the opposite direction will drive the centralizer 20 to rotate about the mandrel 15 in a second opposite direction, once again forcing the cement slurry about the tool 10. Continued longitudinal travel of the centralizer along the mandrel 15 of the tool 10 in the opposite direction forces the cement slurry to be pushed along the tool 10 and the casing string in the opposite direction.

In an embodiment, the guide pins 70 are fastened securely to extend radially inwardly. In an embodiment, the pins 70 are welded to the inner surface 80 of the centralizer. In an alternate embodiment, and as shown in FIGS. 1A and 1B, holes 90 for the guide pins 70 can be drilled through the centralizer 20, guide pins 70 inserted therethrough, and then the pins 70 welded to the centralizer 20.

The tolerance in the annulus between the centralizer 20 and the mandrel 15 is sufficiently tight such that each guide pin 70 remains radially engaged in its corresponding helical groove 65 when the tool 10 is assembled and actuated. Further, in the embodiment of FIG. 1B, where the mandrel 15 comprises the tubular mandrel sleeve 45 (see FIG. 1B), the attachment means used to secure the sleeve 45 to the section 50 of the casing string, such as the set screws 60, are compatible to avoid separation of the sleeve 45 from the casing string during use. Set screws are immune to the reactive torque provided by the action of the helical drive 25 and direction of the helical groove 65.

Referring back to FIG. 3, a pitch of the helical groove 65 may be uniform along the path of the helical groove 65, or may vary to change the speed of rotation of the centralizer 20 (not shown). As shown, the pitch of the helical groove can be about 45°.

Figure 5A:
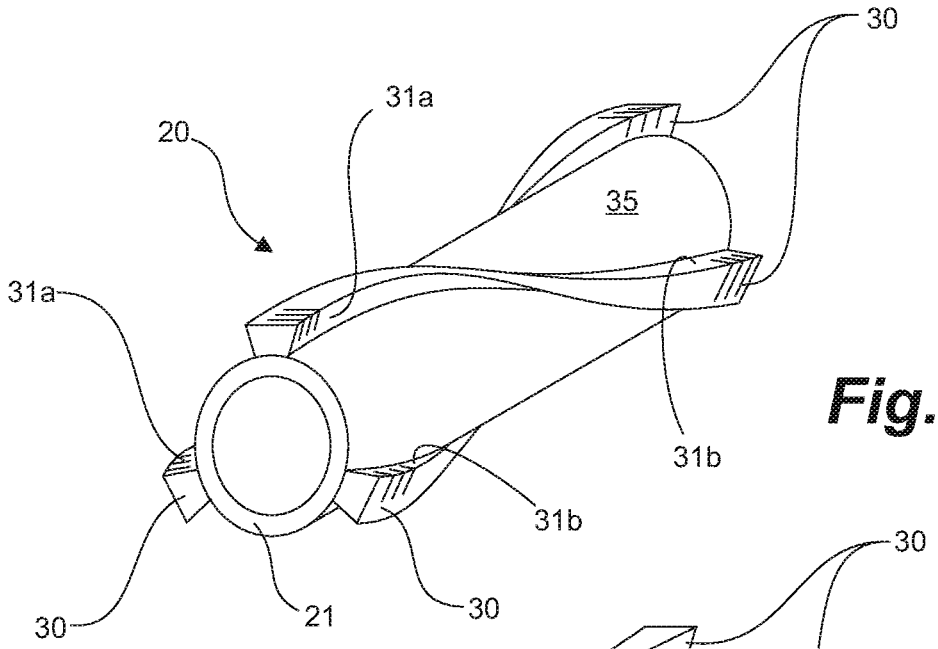
FIG. 5A is a perspective view of an embodiment of a rotatable centralizer, illustrating a centralizer sleeve having three radial helical guides.

With reference to FIG. 5A, in an embodiment, the centralizer 20 comprises a tubular centralizer sleeve 21 and one or more radial guides 30, such as a helical guide, extending along and advancing helically about a length of the sleeve 21. Each radial guide extends radially away from the outer surface 35 thereof for spacing the centralizer sleeve 21 from the wellbore and engaging a portion of the cement slurry thereabout and providing a positive impetus for forcing the cement slurry about the tool 10. Simply, as the one or more radial guide 30 engages the cement slurry, the cement slurry is forced to travel circumferentially about and along the centralizer 20.

As shown, each radial guide further comprises two lateral sides 31*a*,31*b* for engaging the cement slurry and a top 32. As the centralizer 20 rotates in both the clockwise and counterclockwise directions, the radial guides provide the same positive impetus for forcing the cement slurry underneath and about the casing string. Accordingly, lateral side 31*a* can engage the cement slurry when the centralizer 20 rotates in a first direction and lateral side 31*b* can engage the cement slurry when the centralizer 20 rotates in a second opposite direction.

The one or more guides 30 can be two or more guides 30,30 equally spaced apart circumferentially along the outer surface 35 of the centralizer sleeve 21. The lateral sides 31*a*,31*b* can further have a longitudinal profile for defining a cavity for urging or conveying the cement slurry underneath and about the centralizer 20.

Figure 5B:
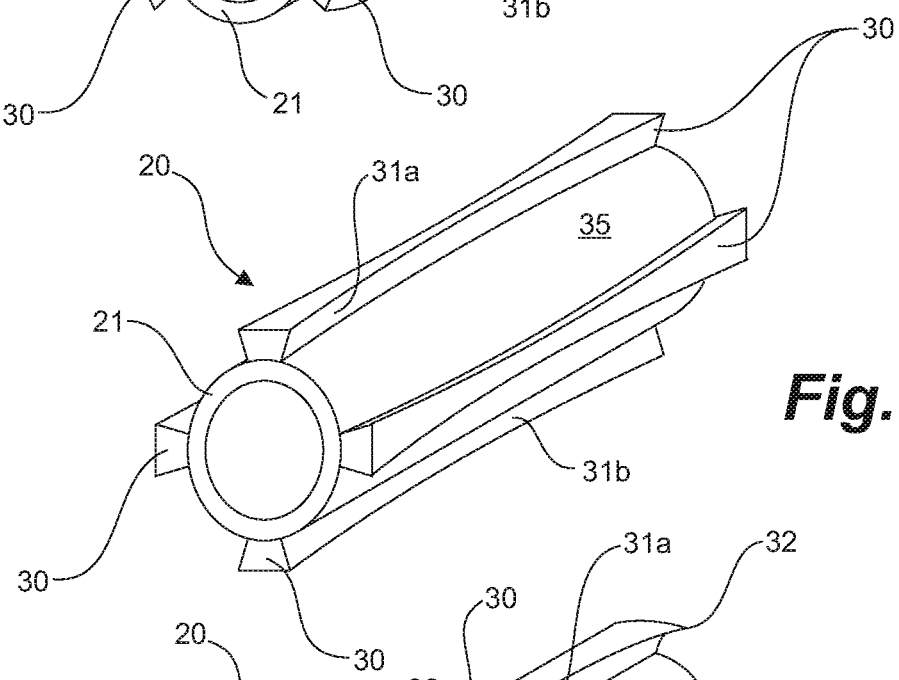
FIG. 5B is a perspective view of an embodiment of a rotatable centralizer, illustrating a centralizer sleeve having four radial guides, each guide having a narrow width at about a midpoint thereof.
Figure 5C:
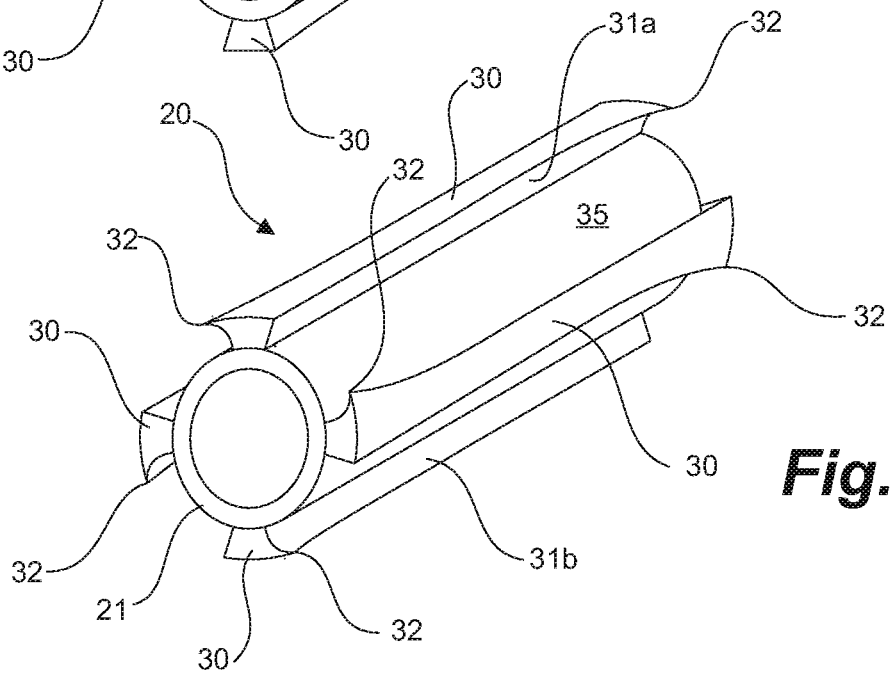
FIG. 5C is a perspective view of an embodiment of a rotatable centralizer, illustrating a centralizer sleeve having four radial guides, each guide having opposing ends that flare.

In an embodiment, and shown in FIG. 5A, the lateral sides 31*a*,31*b* can have a helical profile extending longitudinally and helically about the centralizer sleeve 21. In another embodiment, and as shown in FIG. 5B, the lateral sides 31*a*,31*b* can have a concaved longitudinal profile. In another embodiment, and shown in FIG. 5C, each lateral side 31*a*,31*b* can have a longitudinal profile that can flare to form a scoop 32 at an end.

IN OPERATION

Figure 6A:
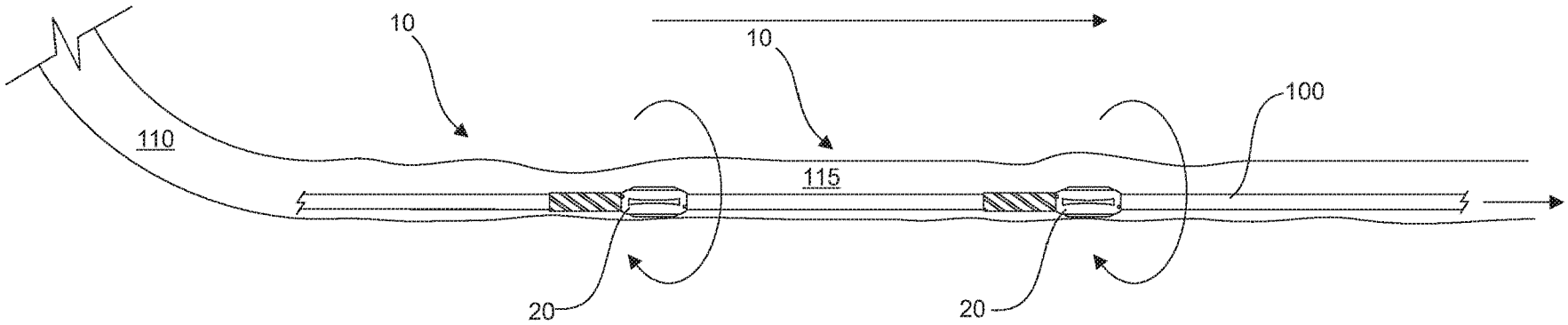
FIG. 6A is a drawing illustrating a positive cement placement tool being stroked downhole and causing a centralizer sleeve to be rotated in a first direction.
Figure 6B:
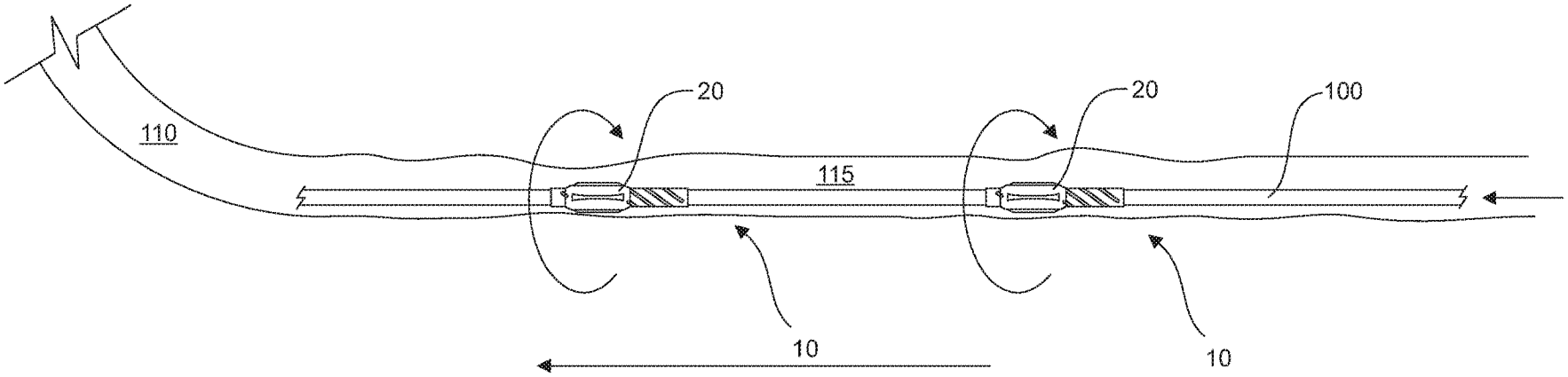
FIG. 6B is a drawing illustrating the placement tool of FIG. 6B being stroked uphole for causing the centralizer sleeve to be rotated in a second opposite direction.

With reference to FIGS. 6A and 6B, in operation, at least one tool 10 and typically a plurality of tools 10, 10 . . . can be located, placed or otherwise disposed along a casing string 100 and run into a horizontal wellbore 110. The casing string 100 and the wellbore 110 form an annulus 115 therebetween. During cementing operations, as the cement slurry is injected or otherwise delivered into the annulus 115 between the casing string 100 and the wellbore 110, the casing string 100 can be axially reciprocated, causing the at least one tool 10 to rotate in either a first or second direction depending on the direction of the stroke.

As shown in FIG. 6A, in an embodiment, a downhole axial movement of the casing string 100 causes the centralizers 20,20 to travel, in a relative sense, in the uphole direction along the mandrel 15 and concurrently rotate in a clockwise direction. The clockwise rotation of the centralizer 20,20 and a paddle-like effect of the guides 30 forces at least some of the cement slurry that is available at one circumferential portion of the annulus 115 to another circumferential location between the casing string 100 and the wellbore 110. At least some of the cement slurry in the annulus 115 that might have settled above a laterally extending portion of the casing string 100 can be forced to another circumferential location along the tool 10.

Similarly, and as shown in FIG. 6B, an uphole axial movement of the casing string 100 causes the centralizers 20,20 to travel in the downhole direction and concurrently rotate in a counterclockwise direction. The counterclockwise rotation of the centralizers 20,20 forces the cement slurry circumferentially about the centralizers 20,20.

Each reciprocal stroking causes the centralizer 20, 20 to rotate in a clockwise direction and then in a counterclockwise direction, providing positive impetus and forcing the cement slurry about the tools 10,10 and the casing string 100. As shown, while the centralizer 20 of each tool 10 may travel along its mandrel 15, the relative position of the centralizer 20 within the wellbore 110 remains substantially the same within the wellbore 110.

Figure 7A:
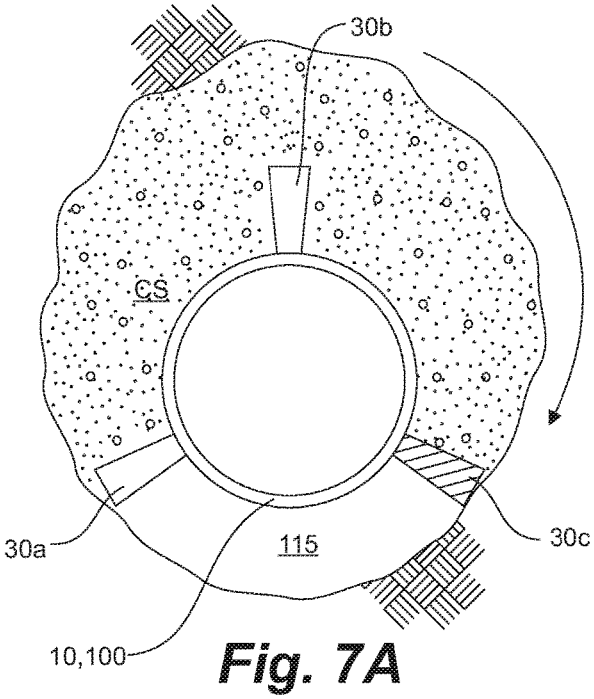
FIGS. 7A to 7C is a series of cross-sectional schematic drawings of an embodiment of a positive cement placement tool placed within a horizontal wellbore and being stroked downhole during the injection of a cement slurry into a wellbore.
Figure 7B:
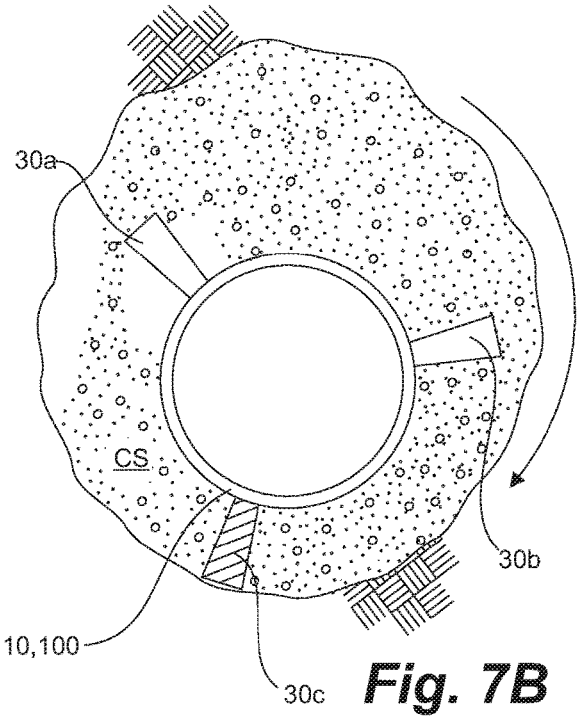
Figure 7C:
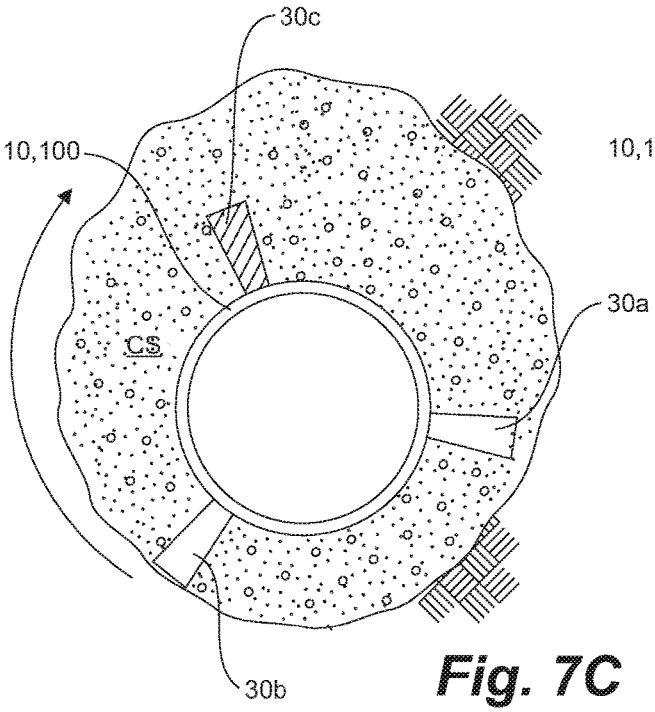

For example, and with reference to FIGS. 7A to 7C, as cement slurry CS is injected into the annulus 115, the cement slurry CS enters into the horizontal wellbore 110 and begins to fill the annulus 115. As the casing string 100 is reciprocated (alternately stroked uphole and downhole) the centralizers are actuated to rotate about the casing string 100.

As shown, and in an embodiment, as the casing string 100 is stroked downhole, the centralizers can rotate in a clockwise direction. At the beginning of the downhole stroke, upper portions of the wellbore 110 are filled in the cement slurry, while a portion of the wellbore 110 below the tool and casing string may not be so filled (See FIG. 7A). With reference to FIG. 7B, as the centralizer rotates clockwise, the radial guides 30*a*,30*b*,30*c* forces the cement slurry from the upper portions of the wellbore 110 around the tool 10 and casing string 100. As radial guide 30*a* approaches the upper portion of the wellbore 110, cement slurry fills the annular space between radial guides 30*a* and 30*c*, all the while, radial guide 30*b* continues to force cement slurry towards the bottom portion of the wellbore 110.

As shown in FIG. 7C, continued rotation of the radial guides 30*a*,30*b*,30*c* results in the forcible placement of the cement slurry about the casing string 100, ensuring that there is a sufficient amount cement slurry CS surrounding the casing string 100 for proper cement bonding to the wellbore 110.

In embodiments, the casing string 100 can be manipulated within the wellbore 110 for relocating the spaced tools 10 along the wellbore 110 to further distribute the cement slurry therealong and therebetween. The tools 10 can be moved further uphole or downhole to repeat the process of forcing the cement slurry about the tools 10 and casing string 100.

EXAMPLE

For a 8¼ inch wellbore, a casing having an outer diameter of about 7 inches can be used as part of the casing string. The casing string can be made up of a plurality of casing sections, each section having a length of about 11½ feet.

A mandrel sleeve having an outer diameter of about 7.6 inches, an inner diameter of about 7.1 inches and a length of about 10 feet, can be fit concentrically about and secured to a casing section using fastening means, such as a plurality of set screws as described above, or a locking collar having similar dimensions as the sleeve.

The 7.6 inch outer diameter of the sleeve provides sufficient material to mill out a 0.2 inch helical groove on its outer surface while still providing sufficient material to maintain structural integrity of the sleeve.

A centralizer having a length of about 5 feet can be manufactured to have an inner diameter of at least about 7.6 inches, so that it can be concentrically fit about the sleeve, and have a maximum outer diameter of about 8¼ inches, so that it can concentrically fit within the wellbore. The guides for engaging the cement slurry can then be milled out from the centralizer. The depth of the guides can be varied to permit the tool to fit within a wellbore having various diameters.

In an embodiment, holes can be tapped along the outer surface of the centralizer, and 1 inch pins of about 0.5 inches in length can be inserted therethrough and then welded into place.

Such an embodiment will provide about two and a half rotations of the centralizer per stroke in either the uphole or downhole direction, ensuring positive placement of cement slurry about and along the casing string during cementing.

The embodiments of the invention for which an exclusive property or privilege is claimed are defined as follows:

1. A method of injecting a cement slurry into a wellbore using a casing string comprising:

securing at least one cement placement tool along the casing string, where the at least one cement placement tool has a centralizer sleeve thereon, the centralizer sleeve having one or more radial guides extending therefrom;

running the casing string, having the at least one cement placement tool, into the wellbore and forming an annulus therebetween;

injecting a cement slurry into the annulus; and driving the centralizer sleeve rotatably for engaging cement slurry at one circumferential location about the casing string and forcing at least some of the cement slurry to another circumferential location between the casing string and the wellbore by actuating a helical drive between the casing string and the centralizer sleeve for rotating the centralizer sleeve first in one direction and then in an opposing direction.

2. The method of claim 1, wherein the driving of the centralizer sleeve about the casing string further comprises manipulating the casing string.

3. The method of claim 1, wherein the driving of the centralizer sleeve about the casing string further comprises stroking the casing string uphole and downhole.

4. The method of claim 3, wherein stroking the casing string uphole rotates the centralizer sleeve in a clockwise direction, and wherein stroking the casing string downhole rotates the centralizer sleeve in a counter-clockwise direction.

5. The method of claim 1, wherein the driving of the centralizer sleeve about the casing string by actuating a helical drive between the casing string and the centralizer sleeve further comprises stroking the casing string uphole and/or downhole.

6. The method of claim 5, wherein stroking the casing string uphole rotates the centralizer sleeve in a clockwise direction, and wherein stroking the casing string downhole rotates the centralizer sleeve in a counter-clockwise direction.

7. A method of injecting a cement slurry into a wellbore using a casing string comprising:

securing at least one cement placement tool along the casing string, where the at least one cement placement tool has a centralizer sleeve thereon, the centralizer sleeve having one or more radial guides extending therefrom;

running the casing string, having the at least one cement placement tool, into the wellbore and forming an annulus therebetween;

injecting a cement slurry into the annulus; and driving the centralizer sleeve rotatably for engaging cement slurry at one circumferential location about the casing string and forcing at least some of the cement slurry to another circumferential location between the casing string and the wellbore by actuating a helical drive between the casing string and the centralizer sleeve by stroking the casing string downhole for rotating the centralizer sleeve in one direction and stroking the casing string uphole for rotating the centralizer sleeve in an opposing direction.

8. The method of claim 7, wherein the driving of the centralizer sleeve about the casing string further comprises manipulating the casing string.

9. The method of claim 7, wherein stroking the casing string uphole rotates the centralizer sleeve in a clockwise direction, and wherein stroking the casing string downhole rotates the centralizer sleeve in a counter-clockwise direction.

* * * * *